US007028657B2

(12) United States Patent
Sah et al.

(10) Patent No.: US 7,028,657 B2
(45) Date of Patent: Apr. 18, 2006

(54) MULTI-STAGE COMPRESSION IGNITION ENGINE START

(75) Inventors: Jy-Jen F. Sah, West Bloomfield, MI (US); Gregory A. Hubbard, Brighton, MI (US); William R. Cawthorne, Milford, MI (US); Xuefeng T. Tao, Northville, MI (US); Todd M. Steinmetz, Indianapolis, IN (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/846,013

(22) Filed: May 14, 2004

(65) Prior Publication Data

US 2005/0252474 A1 Nov. 17, 2005

(51) Int. Cl.
*F02N 11/00* (2006.01)

(52) U.S. Cl. ..... 123/179.3

(58) Field of Classification Search ..... 123/179.3, 123/179.4

See application file for complete search history.

(56) References Cited

U.S. PATENT DOCUMENTS 4,024,408 A * 5/1977 Coleman et al. ..... 123/179.3

5,848,577 A * 12/1998 Sappe et al. ..... 123/179.3

FOREIGN PATENT DOCUMENTS

JP 2002-155774 A * 5/2005

* cited by examiner

*Primary Examiner*—Andrew M. Dolinar
(74) *Attorney, Agent, or Firm*—Christopher DeVries

(57) ABSTRACT

A powertrain includes a diesel compression engine and an electric machine operatively coupled thereto and effective to rotate the engine during engine cranking. Cold engine cranking is accomplished in a staged manner including a first stage wherein the engine is cranked to a first speed below the resonant speed of the coupled engine and electric machine combination for a first duration and thereafter cranked to a second speed above the resonant speed for a second duration. Transition out of cranking at the first and second speeds is accomplished when relative combustion stability is demonstrated. Cranking at the first or second speed is aborted when excessive crank times or if low battery voltages are observed. A third stage is included wherein the engine is cranked to a third speed below the engine idle speed. Transition out of cranking at the third speed is accomplished when relative combustion stability is demonstrated, whereafter normal engine control takes over.

19 Claims, 3 Drawing Sheets

MULTI-STAGE COMPRESSION IGNITION ENGINE START

TECHNICAL FIELD

This invention relates to compression ignition engines. More particularly, the invention is concerned with cold starting of such engines.

BACKGROUND OF THE INVENTION

Compression ignition engines are particularly susceptible to cold-start issues such as slow start times, excessive white smoke exhaust due to misfiring cycles, oil starvation, and poor idle stability. Cold starting means low temperature intake air that is coming inside the cylinder, low temperature walls, and low temperature piston heads. All of these make fuel evaporation difficult which in turn frustrates combustion. Cold starting also means compromised battery voltage which reduces its electrical current capability. The viscosity of oil increases dramatically with decreases in temperature, which results in increased frictional resistance during cold engine starts. The increased frictional drag is especially important when starting compression ignition engines because of the high minimum cranking speed required for starting. Cold temperatures therefore can result in undesirable engine emissions and wasted fuel, slow or no start conditions, battery depletion due to multiple start attempts and displeasing start idle feel. These issues are acute enough that a common practice is to continuously idle compression ignition engines in cold weather, resulting in wasted fuel, increased maintenance problems, and otherwise unnecessary emissions.

Many varied attempts at addressing the cold start issue have been proposed including: optimizing swirl patterns; optimizing fuel injection characteristics; optimizing valve timing events; varying cold start compression ratios; adding start-aid devices, including glow plugs, grid heaters, flame starters, and water heaters; adding passive thermal management to maintain engine/oil temperature above ambient; adding supplemental electrical storage devices such as supercapacitors which are substantially temperature independent; optimizing crankcase lubricants and lubrication systems; etc.

What is needed is a system and method for reliably starting a compression ignition engine during cold conditions which minimizes additional hardware including mechanical and electrical apparatus. Additionally, it is desirable to improve the idle start feel to the operator and a starting system meeting this objective is also needed.

SUMMARY OF THE INVENTION

The present invention provides a method for starting a compression ignition engine. The compression ignition engine is operatively coupled to an electric machine which is effective to spin up the engine during cranking. The starting sequence includes cranking the engine with the electric machine up to a first speed that is below the natural resonant speed of the coupled engine and electric machine combination. First speed cranking is maintained for a first duration and thereafter the engine is cranked up to a second speed that is above the natural resonant speed of the engine and motor combination. The first speed cranking terminates when the engine demonstrates relative stability at the first speed. Similarly, the second speed cranking terminates when the engine demonstrates relative stability at the second speed. Subsequent to the second speed cranking, the engine is cranked up to a third speed that is slightly below the engine idle speed. The third speed cranking terminates when the engine demonstrates relative stability at the third speed, whereafter engine cranking is terminated and normal engine control takes over. Relative stability at the various crank speeds may be determined for example by the engine speed being maintained by engine combustion torque above a predetermined offset from the crank speed for a predetermined time. The amount of the predetermined time may be substantially instantaneous with a high enough offset.

These and other features and advantages of the invention will be more fully understood from the following description of certain specific embodiments of the invention taken together with the accompanying drawings.

DESCRIPTION OF THE PREFERRED EMBODIMENT

Figure 1:
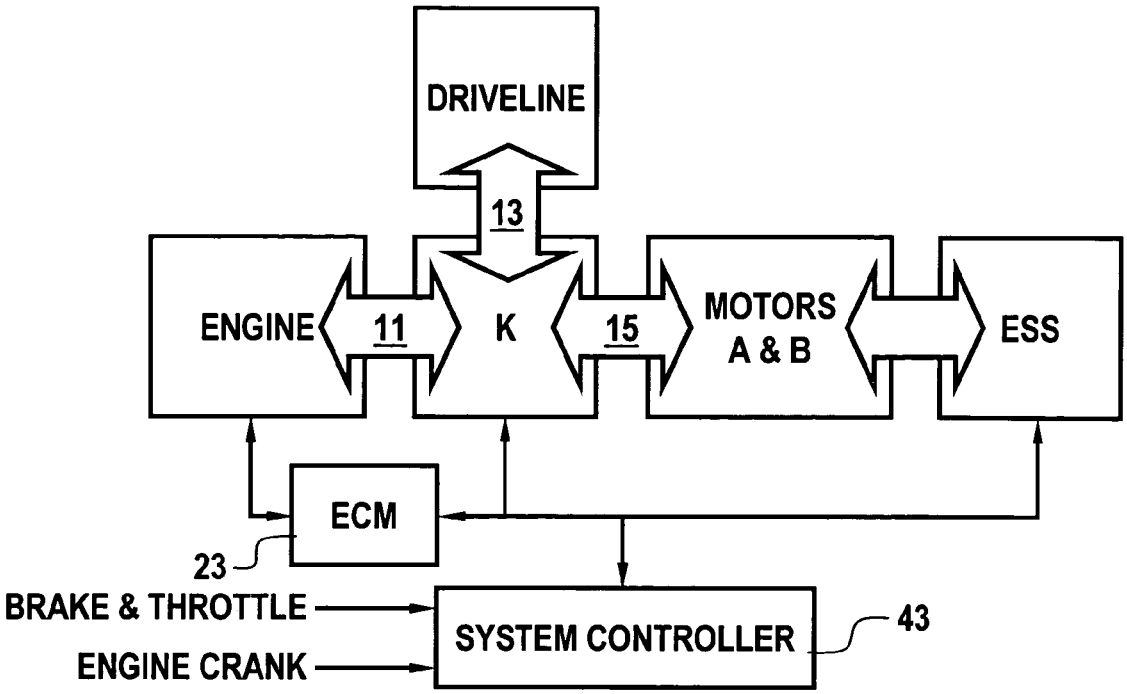
FIG. 1 is a block diagram of a dual-motor, hybrid vehicle powertrain adapted for implementing the present invention.

With reference first to FIG. 1, a block diagram of an exemplary dual-motor, electrically variable transmission powertrain to which the present invention is applicable is illustrated. The powertrain includes a diesel compression ignition engine, a vehicle driveline and a pair of electric motors. The motors (identified as A and B), driveline and engine are operatively coupled to one another, for example, through a coupling means (K) comprising one or more planetary gearsets and selective coupling paths established in accordance with application and release of various torque transfer devices, e.g., clutches. The engine is coupled (11) to the coupling means at a mechanical input thereof. The driveline is coupled (13) to the coupling means at a mechanical output thereof. The motors are coupled (15) to the coupling means at various rotating members of the planetary gearsets. Neglecting power losses, the power flows between the engine, driveline and motors balance. And, the power at the driveline is equivalent to the summation of the powers at the engine and motors. Engine, driveline and motor torques follow the same relationships and are known through the various gearsets, power transmission components and the relationships therebetween as embodied in coupling constraint relationships. Speed relationships between the engine, driveline and motor are also known through the various gearsets, power transmission components and the relationships therebetween as embodied in coupling constraint relationships. The vehicle driveline may include such common driveline components as differential gearsets, propshafts, universal joints, final drive gearsets, wheels and tires. The electric motor receives electric power from and provides electric power to an energy storage system (ESS) which may take the form of one or more batteries in a battery pack module or any appropriate energy storage means capable of bidirectional electrical energy flow. Engine, driveline and motor torques may be in either direction. That is to say, each is capable of bidirectional torque contributions to the powertrain. An exemplary electrically variable transmission comprising a diesel engine, a pair of electric motors and a pair of selectively coupled planetary gearsets and preferred for application of the present control is disclosed in commonly assigned U.S. Pat. No. 5,931,757, the contents of which are incorporated herein by reference.

The exemplary powertrain of FIG. 1 also includes a microprocessor based system controller 43 that communicates with the engine via a conventional microprocessor based engine control module (ECM) 23. The ECM 23 preferably communicates with the system controller 43 over a controller area network (CAN) bus. The engine controller, in turn, is adapted to communicate with various engine actuators and sensors (not separately illustrated) used in the control thereof. For example, fuel injectors, exhaust brake or engine brake actuators and rotation sensors are controlled or monitored by discrete signal lines at the engine controller. Among the engine control functions performed by the ECM 23 is an engine start function which includes conventional engine fueling routines for providing a fuel charge to engine cylinders during forced rotation of the engine by an electrical machine. The system controller 43 receives inputs indicative of operator demands including throttle, brake and engine crank. The system controller 43 communicates with various coupling means actuators and sensors used in the control thereof. For example, output rotation sensors, solenoid control valves for controlling torque transfer device hydraulic pressure and apply/release states thereof, and hydraulic fluid pressure switches or transducers, are controlled or monitored by discrete signal lines. The system controller 43 also communicates similarly with a microprocessor based battery pack controller and microprocessor based power electronics controller (not separately illustrated), collectively referred to as ESS controllers. These ESS controllers preferably communicate with the system controller 43 over a CAN bus. The ESS controllers, in turn, are adapted to provide a variety of sensing, diagnostic and control functions related to the battery pack and motor. For example, current and voltage sensors, temperature sensors, multi-phase inverter electronics and motor rotation sensors are controlled or monitored by the ESS controllers. Included among the functions implemented by the ESS controllers is the engine cranking function which comprises a one sided engine rotation speed control responsive to a crank speed signal effective to rotate, with at least one electric motor, the engine up to the crank speed embodied in the crank speed signal and prevent engine speed from sagging below the crank speed but allowing engine combustion torque to deviate the engine speed from the cranking speed.

The present invention requires that at least one electric motor be operatively coupled to the engine such that the engine can be spun up from a zero speed condition thereby. The motor may couple directly to the engine output shaft or may couple thereto via any variety of gearsets (including reduction gearing) or selectively engageable means such as a starting clutch, range clutch or ring and pinion gear arrangement such as a meshingly engaged starter pinion gear and engine flywheel.

Figure 2:
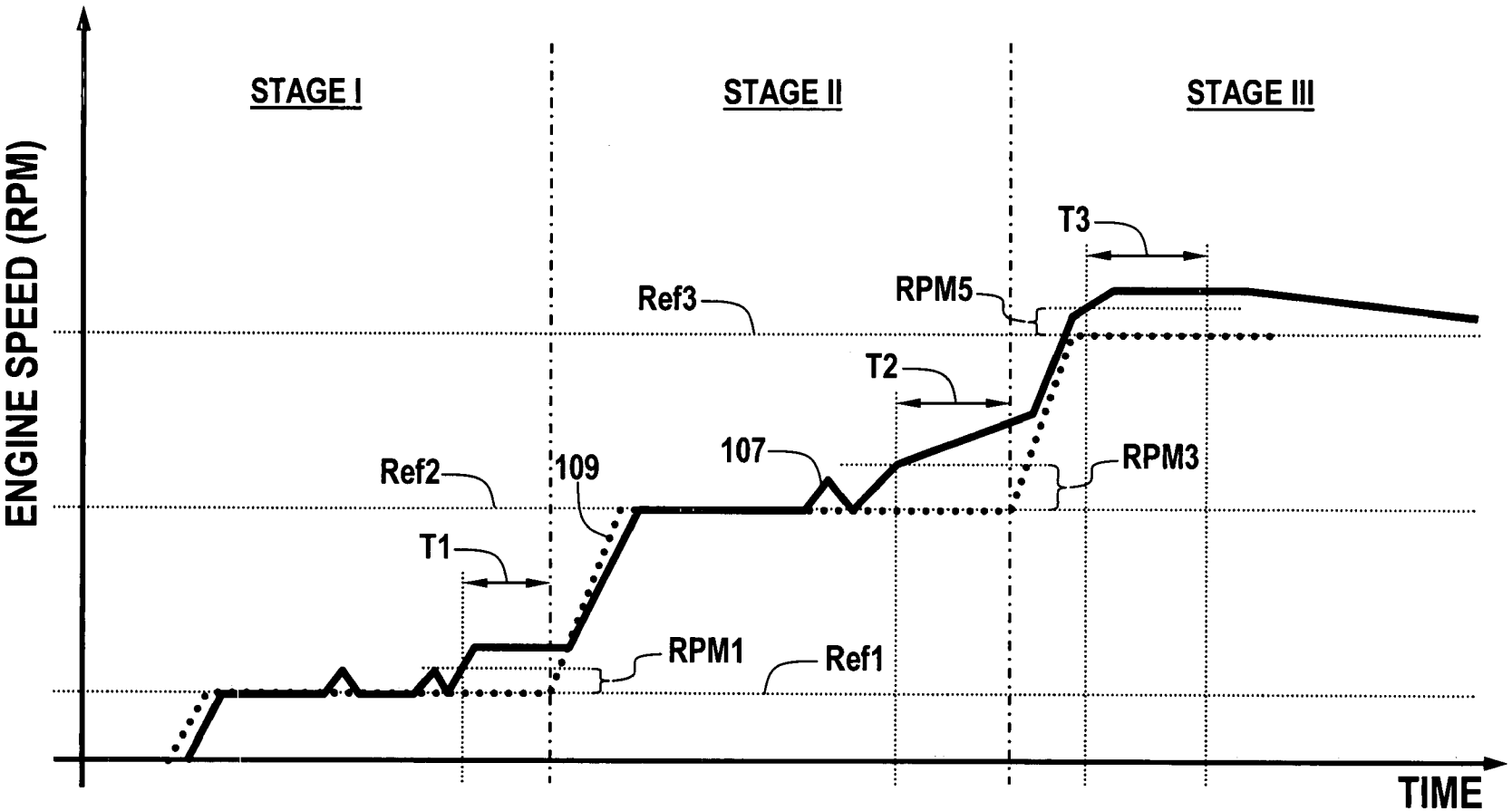
FIG. 2 is a graphical representation of a exemplary multi-stage compression ignition engine start accomplished in accordance with the present invention.
Figure 3:
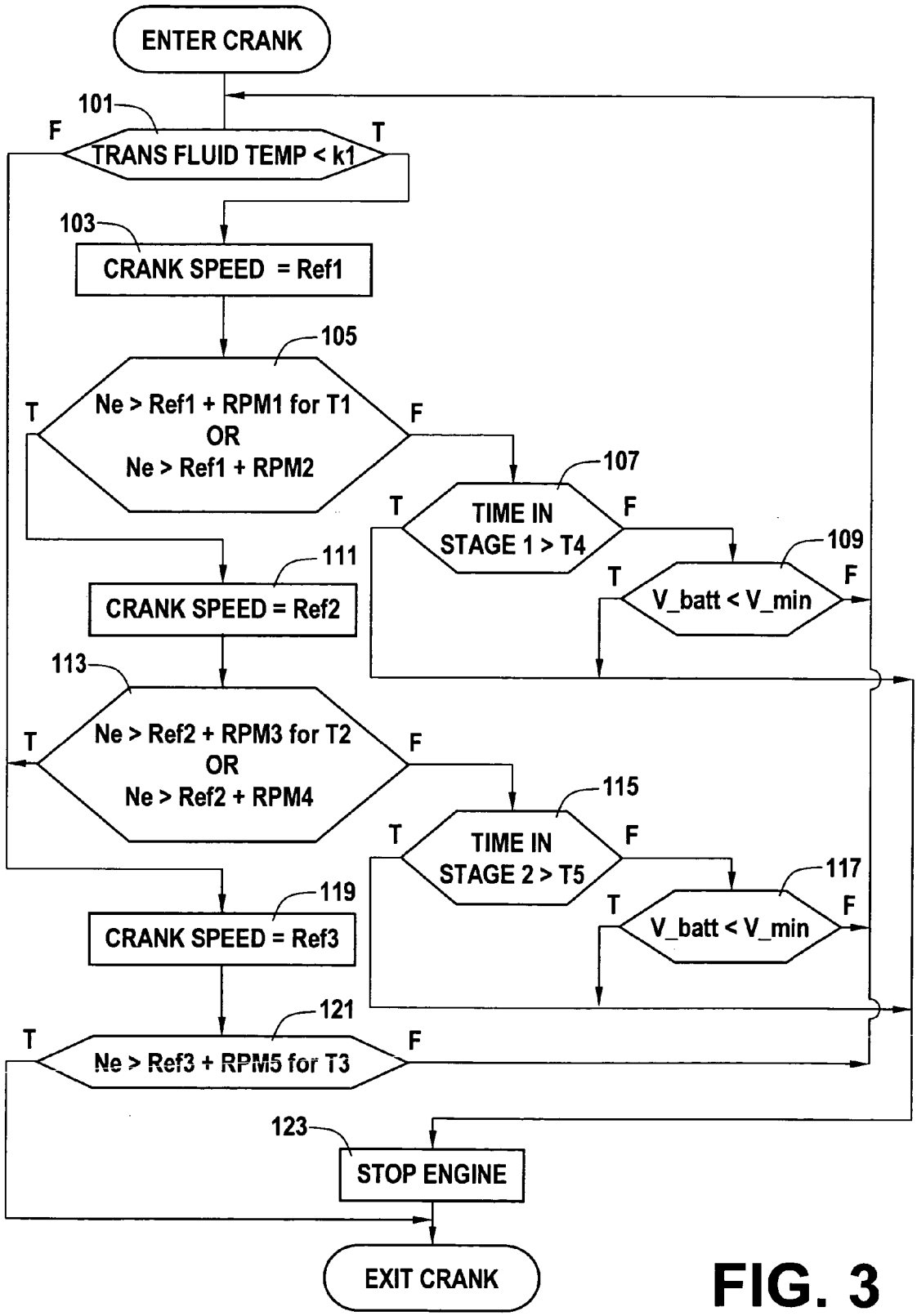
FIG. 3 is a flow chart illustrating exemplary steps implementing the multi-stage compression ignition engine start in accordance with the present invention.

With reference now to FIGS. 2 and 3, a method for cold cranking a diesel engine is illustrated in graphical and flow chart forms, respectively. As used herein, cranking is understood to include forced rotation of the engine such as by an electric machine and engine fueling for combustion torque production. Beginning with reference to FIG. 3, step 101 determines, by way of example to transmission fluid temperature, whether conditions require execution of a cold start cranking in accordance with the invention. Alternative metrics such as engine oil temperature could also be utilized for such a determination. Where transmission fluid temperature is sufficiently high, block 119 is encountered whereat a portion of the start routine begins execution, bypassing other portions of the routine uniquely executed during cold starts. Block 119 and subsequent steps will be described further herein below.

A low transmission fluid temperature at step 101 results in execution of steps, beginning with step 103, uniquely executed during cold starts. At step 103, the engine cranking speed (CRANK SPEED) implemented by the motor control is set to a first reference speed Ref1 which is preferably substantially below any natural resonant frequency of the coupled engine and motor combination effective to avoid exciting undesirable resonant conditions. Additionally, this first reference speed is preferably higher than conventionally realized cold start cranking speeds of substantially 75 to 150 RPM. A cranking speed that is higher than about 150 RPM and preferably about 200 RPM will provide significantly more combustion favorable in cylinder temperatures conditions than conventionally realized cold start cranking speeds. Engine cranking at this controlled CRANK SPEED is a first stage of a stratified engine starting so labeled in FIG. 2 where dotted line 109 represents a cranking speed control profile comprising CRANK SPEED and the solid line 107 represents the actual engine speed as may be established by the cranking torque of the motor or the combustion torque of the engine. The first reference speed used to establish the CRANK SPEED is labeled Ref1 in FIG. 2.

At step 105, engine speed, Ne, is compared to a first threshold comprising the first reference speed, Ref1, plus an additional offset, RPM1, e.g., 30 RPM. If the engine speed exceeds this first threshold for a predetermined time, T1, then it is determined that relative combustion stability at the first reference speed has been adequately demonstrated, for example to indicate some minimum degree of engine torque contribution to engine speed from successful in cylinder combustion events above the first reference speed. Relative combustion stability as used herein is relative to the particular engine speed reference to which it is compared. The engine speed control assists only to prop up the engine speed when it tends to sag below the reference speed, Ref1. It does not provide torque to the engine to establish speed above the reference speed. Any speed excursions above the reference speed, Ref1, is substantially due to combustion torque. An alternative condition which will indicate some minimum degree of engine torque contribution to engine speed from successful in cylinder combustion events above the first reference speed is also demonstrated by the engine speed, Ne, exceeding a second threshold. The second threshold comprises the first reference speed, Ref1, plus an additional offset, RPM2 which is larger than the first offset RPM1, e.g., 150 RPM. The time duration required for the second threshold to be exceeded is minimal and substantially instantaneous as provided by a single control loop.

Where relative combustion stability is not adequately demonstrated at the first reference speed, step 107 next determines whether the engine cranking at the first reference speed, Ref1, within this first stage of cranking, has exceeded a predetermined duration, T4. The time T4 is designed to prevent over draining of the battery system to allow for subsequent start attempts and prevent deeply discharging the battery system. If the cranking has been occurring in the present stage in excess of the acceptable time period, T4, then the current engine starting attempt is aborted at step 123. However, if the acceptable time period, T4, has not been exceeded, a voltage test is performed at step 109 on the battery to determined whether the battery voltage, V_batt is less than an acceptable minimum battery voltage, V_min. If the battery system is deeply discharged, then the current engine starting attempt is aborted at step 123. Where neither the time in the current cranking stage nor the battery voltage condition warrants aborting the cranking attempt, the routine returns to step 101 to continue with the current cranking stage.

Where the relative combustion stability is adequately demonstrated at the first reference speed, step 111 establishes CRANK SPEED implemented by the motor control to a second reference speed Ref2 which is preferably substantially above any natural resonant frequency of the coupled engine and motor combination. The second reference speed used to establish the CRANK SPEED is labeled Ref2 in FIG. 2. The motor control calibrations will establish the ramp rate at which the engine speed is accelerated from Ref1 to Ref2. It is preferred to rapidly move across the speed region between Ref1 and Ref2 to avoid lingering in the region surrounding the natural resonant frequency of the system. The reference speed at this second stage of cranking is still significantly below the engine idle speed, typically about 800 RPM, but substantially above the resonant speed of the coupled engine and motor, for example 400 RPM. Therefore, an exemplary second speed reference is substantially about 600 RPM.

At step 113, engine speed, Ne, is compared to a third threshold comprising the second reference speed, Ref2, plus an additional offset, RPM3, e.g., 50 RPM. If the engine speed exceeds this third threshold for a predetermined time, T2, then it is determined that relative combustion stability at the second reference speed has been adequately demonstrated, for example to indicate some minimum degree of engine torque contribution to engine speed from successful in cylinder combustion events above the second reference speed. Once again, the engine speed control assists only to prop up the engine speed when it tends to sag below the reference speed, Ref2. It does not provide torque to the engine to establish speed above the reference speed. Any speed excursions above the reference speed, Ref2, is substantially due to combustion torque. An alternative condition which will indicate some minimum degree of engine torque contribution to engine speed from successful in cylinder combustion events above the second reference speed is also demonstrated by the engine speed, Ne, exceeding a fourth threshold. The fourth threshold comprises the second reference speed, Ref2; plus an additional offset, RPM4 which is larger than the third offset RPM3, e.g., 100 RPM. The time duration required for the fourth threshold to be exceeded is minimal and substantially instantaneous as provided by a single control loop.

Where relative combustion stability is not adequately demonstrated at the second reference speed, step 115 next determines whether the engine cranking at the second reference speed, Ref2, within this second stage of cranking, has exceeded a predetermined duration, T5. The time T5 is designed to prevent over draining of the battery system to allow for subsequent start attempts and prevent deeply discharging the battery system. If the cranking has been occurring in the present stage in excess of the acceptable time period, T5, then the current engine starting attempt is aborted at step 123. However, if the acceptable time period, T5, has not been exceeded, a voltage test is performed at step 117 on the battery to determined whether the battery voltage, V_batt is less than an acceptable minimum battery voltage, V_min. If the battery system is deeply discharged, then the current engine starting attempt is aborted at step 123. Where neither the time in the current cranking stage nor the battery voltage condition warrants aborting the cranking attempt, the routine returns to step 101 to continue with the current cranking stage.

Where the relative combustion stability is adequately demonstrated at the second reference speed, step 119 establishes CRANK SPEED implemented by the motor control to a third reference speed Ref3 which is preferably slightly below the engine idle speed, typically about 800 RPM. The third reference speed used to establish the CRANK SPEED is labeled Ref3 in FIG. 2. The motor control calibrations will establish the ramp rate at which the engine speed is accelerated from Ref2 to Ref3. While the same resonance considerations that affected the transition from Ref1 to Ref2 are not present, it is preferred to utilize the same ramp rate to accelerate from Ref2 to Ref3. An exemplary third speed reference is substantially 700 RPM.

At step 121, engine speed, Ne, is compared to a third threshold comprising the third reference speed, Ref3, plus an additional offset, RPM3, e.g. 50 RPM. If the engine speed exceeds this third threshold for a predetermined time, T3, then it is determined that relative combustion stability at the third reference speed has been adequately demonstrated, for example to indicate some minimum degree of engine torque contribution to engine speed from successful in cylinder combustion events above the third reference speed. Once again, the engine speed control assists only to prop up the engine speed when it tends to sag below the reference speed, Ref3. It does not provide torque to the engine to establish speed above the reference speed. Any speed excursions above the reference speed, Ref3, is substantially due to combustion torque.

Where relative combustion stability is not adequately demonstrated at the third reference speed, the routine returns to step 101 to continue with the current cranking stage. This third stage cranking also serves as the normally invoked warm cranking mode. As previously described, where it is determined at step 101 that the cold cranking routine of the previously described steps are not required, as indicated for example by warm transmission fluid, this third stage routine is performed and the first two stages are bypassed as unnecessary for successful engine starting at present conditions.

Where the relative combustion stability is adequately demonstrated at the third reference speed, step 121 exits the start routine and engine control is turned over to normal engine control routines, including engine speed control routines to maintain idle speed and engine torque control routines responsive to operator torque demands.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invetion claimed is:

1. Method for starting a compression ignition engine operatively coupled to an electric machine, comprising:

cranking the engine with the electric machine up to a first speed substantially below a natural resonant speed of the operatively coupled engine and electric machine combination for a first duration; and thereafter cranking the engine with the electric machine up to a second speed substantially above the natural resonant speed of the operatively coupled engine and motor combination;

wherein said first duration terminates when the engine demonstrates relative stability at said first speed.

2. Method for starting a compression ignition engine operatively coupled to an electric machine, comprising:

cranking the engine with the electric machine up to a first speed substantially below a natural resonant speed of the operatively coupled engine and electric machine combination for a first duration; and thereafter cranking the engine with the electric machine up to a second speed substantially above the natural resonant speed of the operatively coupled engine and motor combination;

wherein said first duration terminates when the engine speed exceeds a predetermined speed above said first speed for a predetermined time under engine combustion power.

3. Method for starting a compression ignition engine operatively coupled to an electric machine, comprising:

cranking the engine with the electric machine up to a first speed substantially below a natural resonant speed of the operatively coupled engine and electric machine combination for a first duration; and thereafter cranking the engine with the electric machine up to a second speed substantially above the natural resonant speed of the operatively coupled engine and motor combination;

wherein the engine is cranked with the electric machine up to the second speed for a second duration, and thereafter cranking the engine with the electric machine up to a third speed slightly below engine idle speed for a third duration.

4. The method for starting a compression ignition engine as claimed in claim 3, wherein said first and second durations terminate when the engine demonstrates relative stability at said respective first and second speeds.

5. The method for starting a compression ignition engine as claimed in claim 4 wherein said first duration terminates when the engine speed exceeds a predetermined speed above said first speed for a predetermined time under engine combustion power, and said second duration terminates when the engine speed exceeds a predetermined speed above said second speed for a predetermined time under engine combustion power.

6. Method for starting a compression ignition engine operatively coupled to an electric machine, comprising:

cranking the engine with the electric machine up to a first speed substantially below a natural resonant speed of the operatively coupled engine and electric machine combination for a first duration; and thereafter cranking the engine with the electric machine up to a second speed substantially above the natural resonant speed of the operatively coupled engine and motor combination;

wherein cranking at either of the first and second speeds is aborted if cranking at the respective speed continues for a predetermined excessive time.

7. The method for starting a compression ignition engine as claimed in claim 1 wherein cranking at either of the first and second speeds is aborted if battery voltage drops below a predetermined minimum voltage.

8. The method for starting a compression ignition engine as claimed in claim 1 wherein said first speed is about 150 RPM to about 250 RPM.

9. The method for starting a compression ignition engine as claimed in claim 1 wherein said second speed is about 550 RPM to about 650 RPM.

10. Method for starting a compression ignition engine operatively coupled to an electric machine, comprising:

cranking the engine with the electric machine up to a first speed; and cranking the engine with the electric machine up to a second speed after the engine has demonstrated relative combustion stability at said first speed.

11. The method for starting a compression ignition engine as claimed in claim 10 wherein said first speed is below a natural resonant speed of the operatively coupled engine and electric machine combination and said second speed is above said natural resonant speed of the operatively coupled engine and electric machine combination.

12. The method for starting a compression ignition engine as claimed in claim 10 further comprising cranking the engine with the electric machine up to a third speed after the engine has demonstrated relative stability at said second speed.

13. The method for starting a compression ignition engine as claimed in claim 12 further comprising cranking the engine with the electric machine up to a third speed after the engine has demonstrated relative stability at said second speed.

14. Stratified engine cranking method for a compression ignition engine operatively coupled to an electric machine comprising:

cranking the engine from a stop to a first speed and controlling an engine speed lower limit to said first speed while allowing the engine speed to advance to higher speeds under engine combustion power; and thereafter upon predetermined engine speed advances, cranking the engine to a second speed and controlling the engine speed lower limit to said second speed while allowing the engine speed to advance to higher speeds under engine combustion power.

15. The stratified engine speed cranking method as claimed in claim 14 further comprising:

subsequent to cranking the engine to said second speed, cranking the engine to a third speed and controlling the engine speed lower limit to said third speed while allowing the engine speed to advance to higher speeds under engine combustion power.

16. The stratified engine speed cranking method as claimed in claim 14 wherein said first speed is below a natural resonant speed of the operatively coupled engine and electric machine combination and said second speed is above said natural resonant speed of the operatively coupled engine and electric machine combination.

17. The stratified engine speed cranking method as claimed in claim 15 wherein said first speed is below a natural resonant speed of the operatively coupled engine and electric machine combination and said second speed is above said natural resonant speed of the operatively coupled engine and electric machine combination.

18. The stratified engine speed cranking method as claimed in claim 15 wherein said third speed is slightly below engine idle speed.

19. The stratified engine speed cranking method as claimed in claim 15 wherein said first speed is below a natural resonant speed of the operatively coupled engine and electric machine combination, said second speed is above said natural resonant speed of the operatively coupled engine and electric machine combination and said third speed is slightly below engine idle speed.

* * * * *